US006546567B2

(12) United States Patent
Kuzniar

(10) Patent No.: US 6,546,567 B2
(45) Date of Patent: Apr. 15, 2003

(54) COMMODE VENTILATION SYSTEM

(76) Inventor: Randy L. Kuzniar, 503 Knollwood Dr., Mauldin, SC (US) 29662

( * ) Notice: Subject to any disclaimer, the term of this patent is extended or adjusted under 35 U.S.C. 154(b) by 0 days.

(21) Appl. No.: 09/933,217

(22) Filed: Aug. 20, 2001

(65) Prior Publication Data

US 2002/0069456 A1 Jun. 13, 2002

Related U.S. Application Data

(63) Continuation-in-part of application No. 09/704,921, filed on Nov. 2, 2000, now abandoned.

(51) Int. Cl.[7] ..... E03D 9/04
(52) U.S. Cl. ..... 4/217
(58) Field of Search ..... 4/217

(56) References Cited

U.S. PATENT DOCUMENTS 3,069,696 A 12/1962 Howell
3,659,296 A 5/1972 Stamper
3,740,772 A * 6/1973 Paley ..... 4/217
4,200,940 A 5/1980 Buchanan
4,301,555 A * 11/1981 Poister ..... 4/217
4,344,194 A 8/1982 Pearson
4,586,201 A 5/1986 Todd, Jr.
5,079,783 A * 1/1992 Haletsky et al. ..... 4/217
5,452,481 A 9/1995 Meyer
5,539,937 A 7/1996 Barefoot
5,638,553 A 6/1997 Loewen et al.

FOREIGN PATENT DOCUMENTS

DE 2906152 * 8/1980 ..... 4/217

* cited by examiner

*Primary Examiner*—Charles E. Phillips
(74) *Attorney, Agent, or Firm*—Dority & Manning, PA

(57) ABSTRACT

An improved apparatus for ventilating bathroom odors of a commode is provided. The apparatus provides a seat containing an entire ventilation system including an intake, an air plenum positioned within the interior of the seat. At least one air filter is positioned within the air passage. A fan or blower motor is used to move air through the air passage and the filtered air exits through an edge of the seat, the blower fan controlled by a battery pack contained within the commode seat. An external pushbutton switch sets a time that controls operation of the ventilation system. The replaceable filter is accessible from an outer edge of the commode seat.

14 Claims, 10 Drawing Sheets

COMMODE VENTILATION SYSTEM

RELATED APPLICATIONS

This application is a Continuation-in-Part of application Ser. No. 09/704,921 filed Nov. 2, 2000, now abandoned which is incorporated herein by reference.

FIELD OF THE INVENTION

The present invention relates to a ventilation system for a commode. More particularly, the present invention relates to a compact ventilation system that removes and filters airborne odors and does so making use of a compact design and apparatus that is self-contained within the interior of a standard size commode seat.

BACKGROUND OF THE INVENTION

The prior art has identified the problem of removing objectionable odors from bathrooms. A variety of products have been developed directed to masking or removing odors from a bathroom. In particular, odors associated with the use of a commode are objectionable to most persons. Where there are multiple users of a bathroom or commode, typical ceiling mounted ventilation systems are not adequate to remove odor-containing air in a sufficiently rapid manner.

A variety of masking aerosol scents is used to render odors less objectionable. However, some persons find the use of airborne perfumes or scents objectionable in their own right and may exacerbate allergy symptoms in some individuals.

Among some of the devices developed as a means of deodorizing commodes and bathroom environments include the use of ventilation devices which are designed to evacuate and discharge odor borne air from the bathroom environment. One such device may be seen in reference to U.S. Pat. No. 3,069,696 to Howell. The ventilation device of Howell uses a vacuum-type apparatus to remove air from the proximity of the commode and then discharges the air at a remote location. The arrangement of Howell merely transports odors from one area to another. Further, the conventional vacuum-type apparatus proposed by Howell is quite loud in operation.

U.S. Pat. No. 3,659,296 to Stamper discloses a toilet seat using a fan to discharge a deodorizing scent. The fan may be battery operated and may be controlled by a pressure-operated switch that activates when a person is seated on the commode. However, the apparatus of Stamper provides only a very short flow pathway in which conditioning or treating the air may occur. Further, the air discharge outlet of the Stamper device is directed against the tank or reservoir wall of the commode. As such, the effective operation of the unit is easily blocked by a person's clothing when seated on the commode.

U.S. Pat. No. 4,200,940 to Buchanan discloses a hollow toilet seat that is connected to an external vacuum supply. The removed air is passed through an incineration unit in an effort to purify the air. However, this apparatus requires a large, bulky structure adjacent to the commode as well as ready access to an electrical outlet. Further, the operation of an indoor incinerary device may not be safe in the presence of small children and serves as an undesired heat source during hot weather.

U.S. Pat. No. 4,586,201 to Todd, Jr., discloses a ventilation apparatus for a commode in which air moving and deodorizing means are mounted within a commode lid. The Todd Jr., apparatus makes further use of a hollow toilet seat that may limit the strength and, therefore, materials from which a toilet seat may be constructed.

Overall, the prior art has not find acceptance among consumers as providing an effective, esthetically discrete, and self-contained apparatus for the removal of odors associated with the use of a commode. Accordingly, there is room for variation and improvement within the art.

SUMMARY OF THE INVENTION

The present invention addresses some of the problems identified above by providing an improved apparatus for the filtration and elimination of airborne odors associated with the commode. More particularly, the present invention provides for a new apparatus which is self-contained within a standard size commode seat and which provides for an air removal pathway, a filter, an air-moving device, along with a power source for the air moving device. In addition, the present invention is esthetically pleasing in that it has the appearance of a conventional toilet seat. Further, the operation of the apparatus lends itself to quiet and unobtrusive operation.

Accordingly, in one embodiment of the invention, a toilet seat is provided having an air inlet positioned along the inner rim or lower edge of the commode seat. The air intake is in communication with an air channel that directs the airflow to a first filter. Upon exiting the carbon filter, the air flow continues along a path defined within the interior of the commode seat and passes through a carbon filter before exiting through a blower motor positioned within the commode seat. The treated air is discharged from the floor along the side or rear of the commode seat. One or more filter elements are housed within an opening accessible from the outer edge of the toilet seat to facilitate removal and replacement of the cartridges. A simple rocker switch is provided along one edge of the toilet seat to control the operation of the air blower unit. A rechargeable battery source is also provided within a housing defined by the commode seat and provides a power source for the blower motor.

It is an additional aspect with regard to at least one embodiment of the present invention to provide a commode seat in which the seat defines an upper half and a lower half, the respective seat halves collectively defining housings in which the battery source, blower motor, and filter elements reside. Further, the upper and lower halves cooperatively define an air passage extending from the bottom of the commode seat, through a first seat half, into a second seat half and which further extends into the lower seat half where an outlet is defined.

These and other features, aspects, and advantages of the present invention will become better understood with reference to the following description and appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures, although such apparatus or process is labeled with the same reference numbers.

Figure 1:
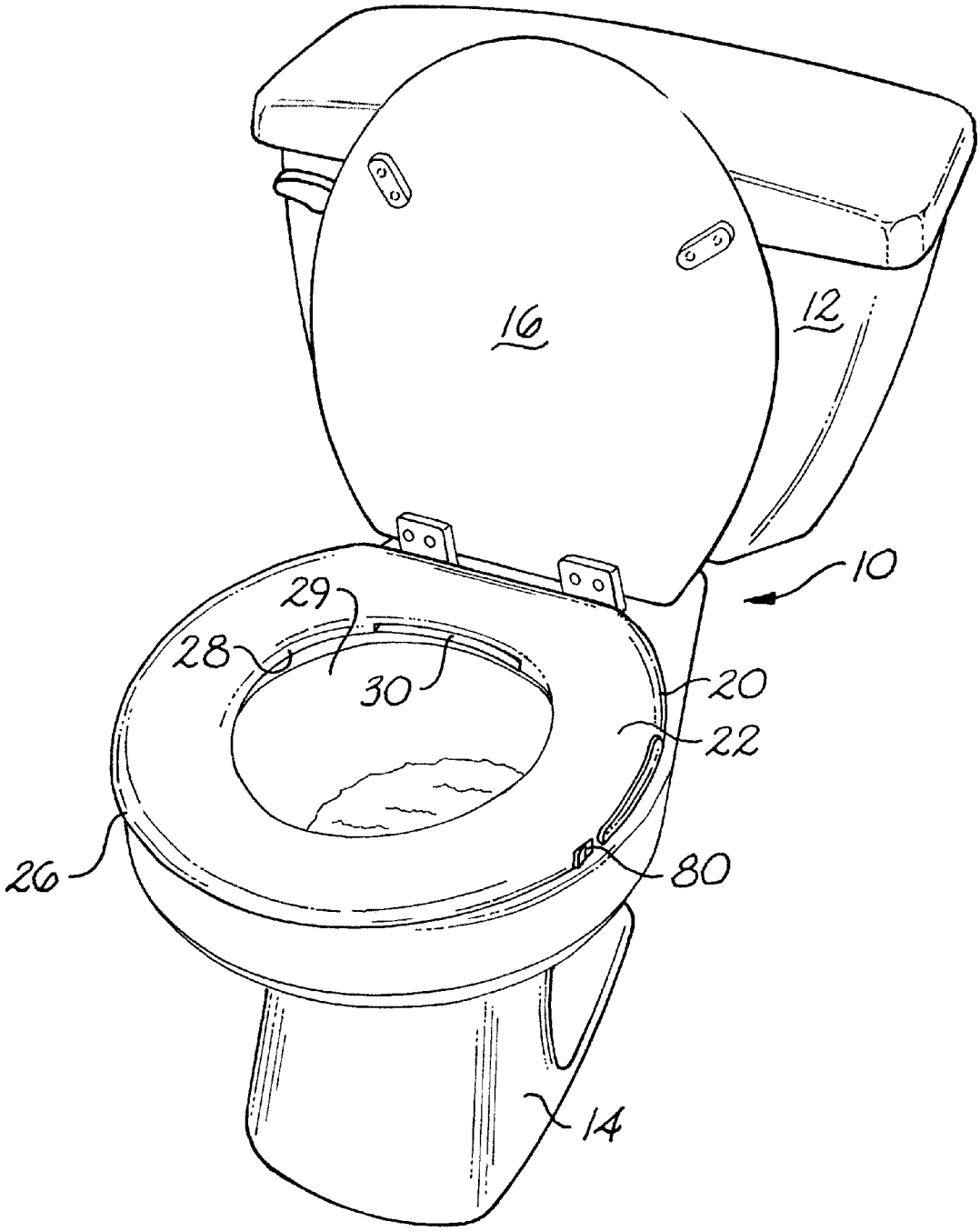
FIG. 1 is a front perspective view of a commode having a commode seat constructed according to the present invention.

An embodiment of the present invention may be seen in reference to FIG. 1 in which a conventional commode 10 having a reservoir tank 12 is situated on a base 14. A lid 16 may be provided as is conventional within the art. A commode seat 20 defines an upper surface 22, a lower surface 24, lower surface 24 having a flexible gasket 25 which provides a substantially air tight seal between the seat and the rim 18 (FIG. 2) of the commode. Seat 20 further provides an exterior edge 26 and an inner edge 28, the inner edge 28 surrounding the opening 29 defined by seat 20.

Figure 4:
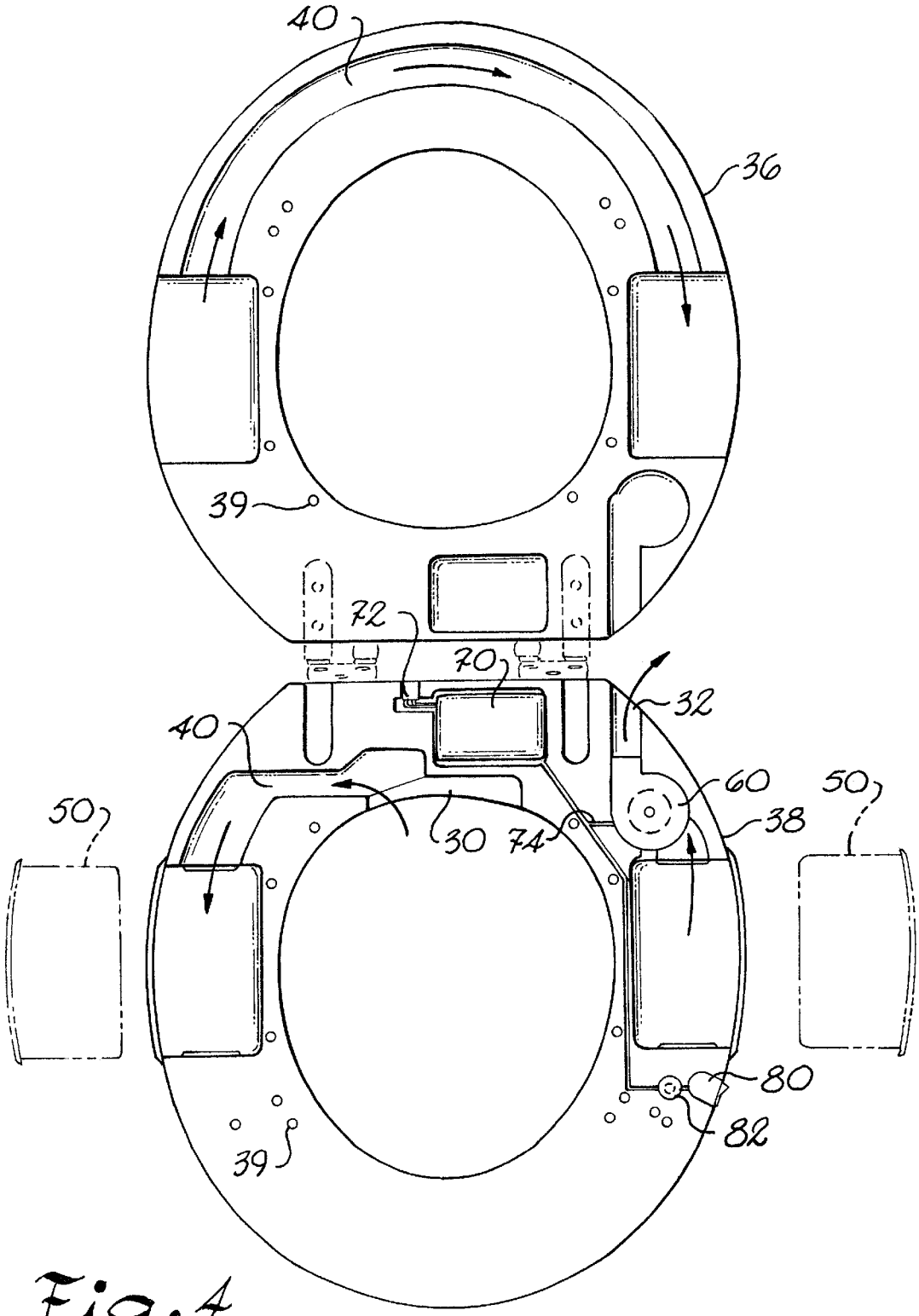
FIG. 4 is a top plan view of the commode seat showing an upper half and a lower half of the commode seat setting forth details of the component parts and air flow pathways collectively defined between the upper and lower hemispheres.

As best seen in reference to FIG. 4, the commode seat 20 is formed of two separate halves including an upper half 36 and a lower half 38. Upper half 36 and lower half 38 may be secured to each other by a plurality of dowels (not illustrated) which engage a plurality of aligned apertures 39 with the respective seat halves 36 and 38. The provision of upper and lower seat halves facilitate the construction of the air pathways and placement of operative components as will best be described below. However, other conventional attachment mechanisms such as a snap-fit configuration, adhesives, or other joining hardware may be used between the respective halves.

Figure 2:
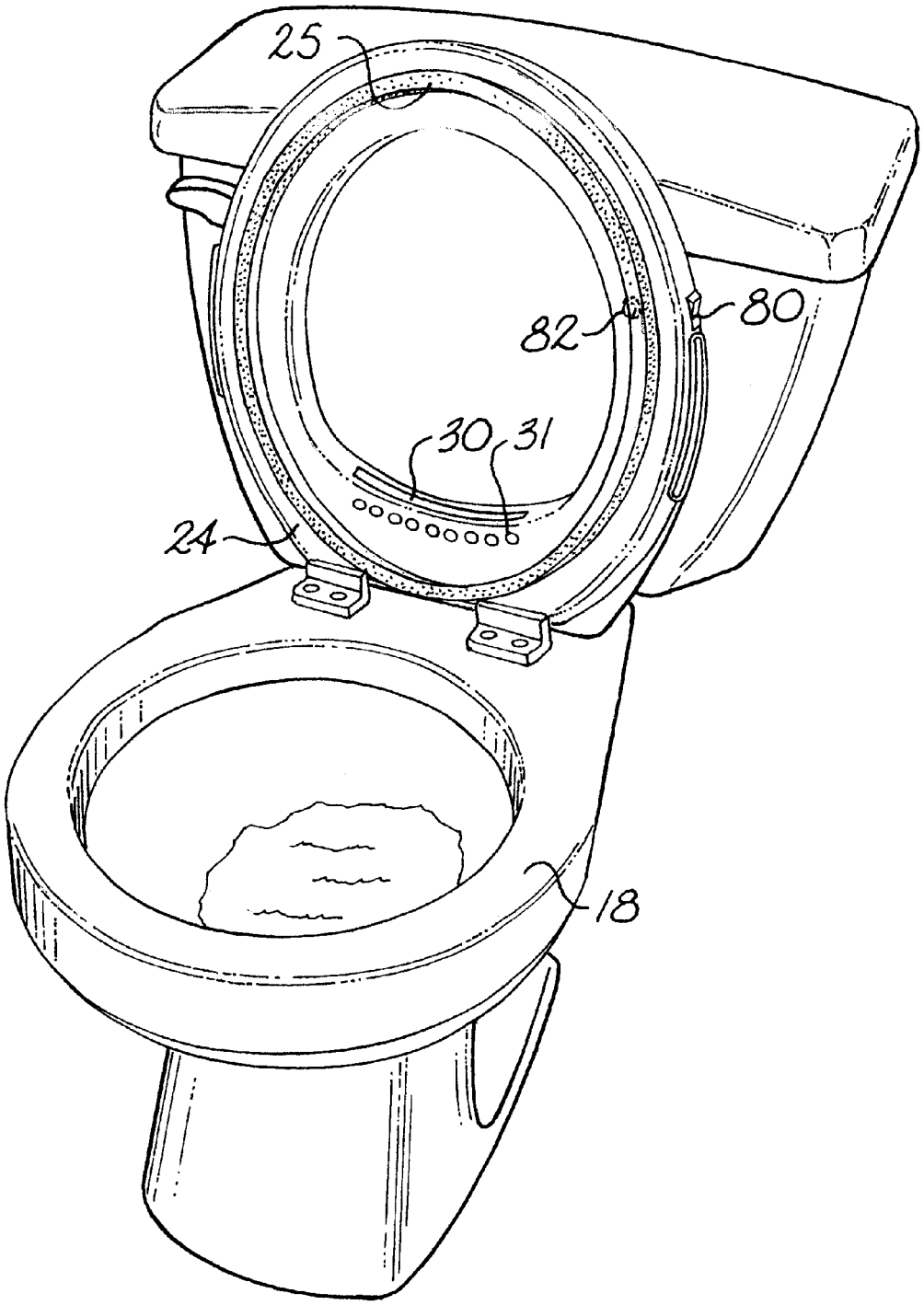
FIG. 2 is a different view of the embodiment of FIG. 1 that depicts the commode seat in a raised, non-seated position.
Figure 3:
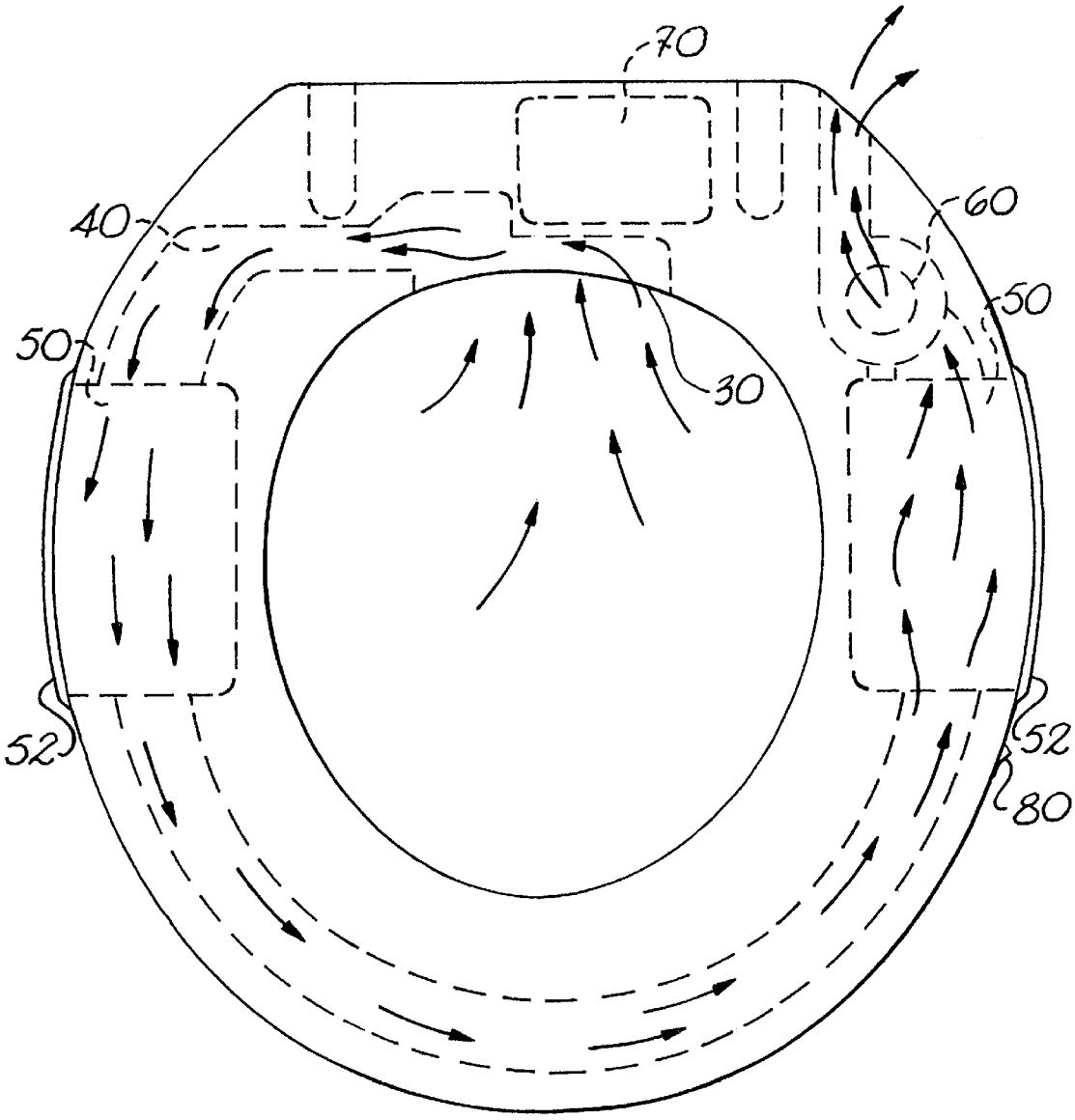
FIG. 3 is a top plan view of the commode seat seen in FIG. 1 and illustrating the air flow pathway of the commode seat.

Seat 20 defines an air intake that is preferably located along either an inner edge or bottom surface of seat 20. In one embodiment, intake 30 comprises a slot defined along an inner edge 28 of the seat. However, as seen in FIG. 2, a plurality of intakes 31 may be provided as an additional or sole means of air intake. The intake 30 is in communication with an air plenum 40, the shape and direction of air plenum 40 best seen in reference to the directional arrows in FIGS. 3 and 4. The directional arrows indicate the flow of air through plenum 40, the air movement being controlled by a fan such as a blower motor 60. The operation of blower motor 60 discharges air from a blower outlet through outlet 32 defined by seat 20. The movement of air generated by blower 60 establishes a substantially circular air pathway of air entering intake 30 and continuing through plenum 40. The pathway of plenum 40 passes the moving air through a first filter 50. Filter 50 is preferably a mesh-type pre-filter contained within a filter cartridge 52. Cartridge 52 designed to operatively place filter 50 within the pathway of air plenum 40 thereby forming a portion of the pathway when the filter is inserted. In a preferred embodiment, the airflow enters through a bottom of filter 50 and exits through an upper surface of the filter. The first filter 50 thereby provides a transition point from the air plenum 40 contained within the lower half 38 and upper half 36.

Figure 5:
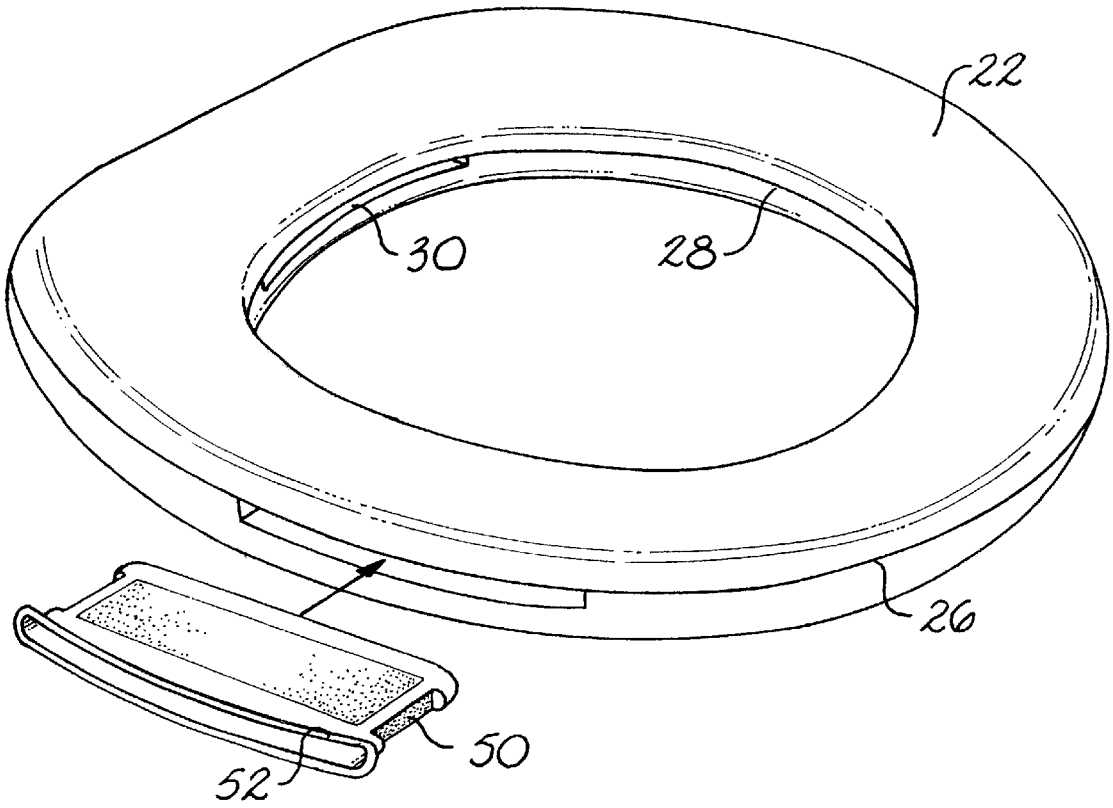
FIG. 5 is an isolated, side perspective view showing the operation of a removable filter cartridge that is being inserted into a defined housing along an edge of the commode seat.

As best seen in reference to FIG. 4, air entering the bottom of filter 50 exits the opposite side and continues along an arcuate portion of plenum 40 positioned within the upper half 36 of the commode seat 20. The air path is in further communication with a second filter 50 and filter cartridge 52 configured similarly as to the filter previously described. The second filter 50 contains activated carbon to help in the removal of odors. As seen in reference to FIGS. 4 and 5, the first and second filters 50 and cartridges 52 are adapted for being inserted into and received by a slot and housing defined within the interior of seat 22. This removable cartridge facilitates the periodic replacement of the various filters 50 without the necessity of disassembling the seat. Further, the edge-accessible cartridges provide easy access compared to rear mounted or bottom mounted filtering media. However, a variety of different filtering media may be used and having different configurations, so long as air flow through the filter is achieved and the filter composition has sufficient filtering qualities to remove or treat bathroom odors.

Upon exiting the second filter 50, air is directed along plenum 40 to blower 60. An intake of blower 60 receives the air and discharges the air from blower 60 through seat outlet 32.

As seen in reference to FIG. 4, a battery source 70 is provided within a housing defined within the interior of seat 22. Power supply 70 may be provided by conventional batteries, including a rechargeable battery pack. If a rechargeable power supply is used, it is convenient to provide an access port 72 for a conventional connection for a re-charger.

Electrical leads 74 connect the power source 70 to blower motor 60. Further, switch 80, seen here in the form of a rocker switch, may be provided to control the operation of the blower fan 60. If desired, a pressure contact switch 82 may also be used to limit operation of the blower fan 60 to intervals when the seat 20 bears the weight of a seated individual. For either type of switch, it is desirable that the switch be responsive to a timer circuit so as to provide for a 10-minute interval of operation before the blower motor is automatically turned off. Use of the timer circuit conserves battery life and also provides for an interval of operation once the user has left the bathroom facility.

The illustrated embodiment is constructed from a conventional wooden toilet seat. The air plenum 40 and associated housings for housing the battery supply 70, the fan blower 60, filters 50, and other structures related to the operation of the air filtering system, may be milled or routed from the wood. One having ordinary skill in the art would be able to provide an equivalent structure from molded plastic or other materials. However, a wooden seat remains the material of choice for most consumers. Further, the wood construction maintains the seat strength when constructed in accordance with this invention.

The strength of the resulting seat is also enhanced by making use of both the upper and lower hemispheres to define the various compartments and air pathways so that the structural strength of the seat may be maintained. For instance, air plenum 40 is initially defined within the lower seat half 38 before engaging filter 50. The air plenum 40 continues from filter 50 along the plenum pathway defined solely within the upper half 36. This arrangement insures that air flow must pass through filter 50 along this pathway. The reverse arrangement occurs with respect to the second filter 50 which directs air passing from the upper to the lower surface of the filter through a portion of the air plenum now defined within lower seat half 38.

The illustrated embodiment set forth above uses two filter cartridges that are aligned in series along the inner pathway. It is understood and appreciated by those having ordinary skill in the art that depending upon the efficiency of the air filtration cartridge, a single cartridge may be operative to remove odors associated with the use of the commode. If desired, an existing cartridge or additional dispenser may be adapted or provided within the air flow to release a masking scent or air freshener.

It has been found advantageous to use a blower motor such as a Delta Motor BF B0512H manufactured by Delta Motor Company, Long Beach, Calif. The Delta blower motor is compact, very quiet in operation, and provides a sufficiently high volume of air flow and pressure drop to bring about the desired displacement of air from the bowl region of the commode and through the toilet seat air passage.

The first filter 50 may be provided by a HEPA filter such as ACA 5030 available from Duracraft Corporation, South Borough, Mass. The combination of filters provide effective odor control, a sufficiently long service life, and have a compact design allowing them to fit within the confines of a conventional commode seat. The second filter 50 may be constructed of conventional activated carbon material and configured within the housing for receiving air along an upper surface of the filter and discharging the air along the lower surface of the filter and into the lower half of the commode seat.

One suitable commode seat for practicing the present invention makes use of a Beamis brand seat having model number 400-BP available from Beamis Manufacturing, Shegowgane Falls, Mich. This particular model is a wooden seat having a very thin profile. Accordingly, by sizing the components to fit within a thin seat, allows the same design to be adapted for thicker seat structures.

The power supply 70 may be removed along an access opening defined along the rear edge of the commode seat. The compartment housing the power source 70 is tightly configured so as when a fresh battery supply is inserted, the required electrical connections are re-established as is conventional within the art of battery-operated devices such as cellular phones, calculators, and the like.

Figure 6:
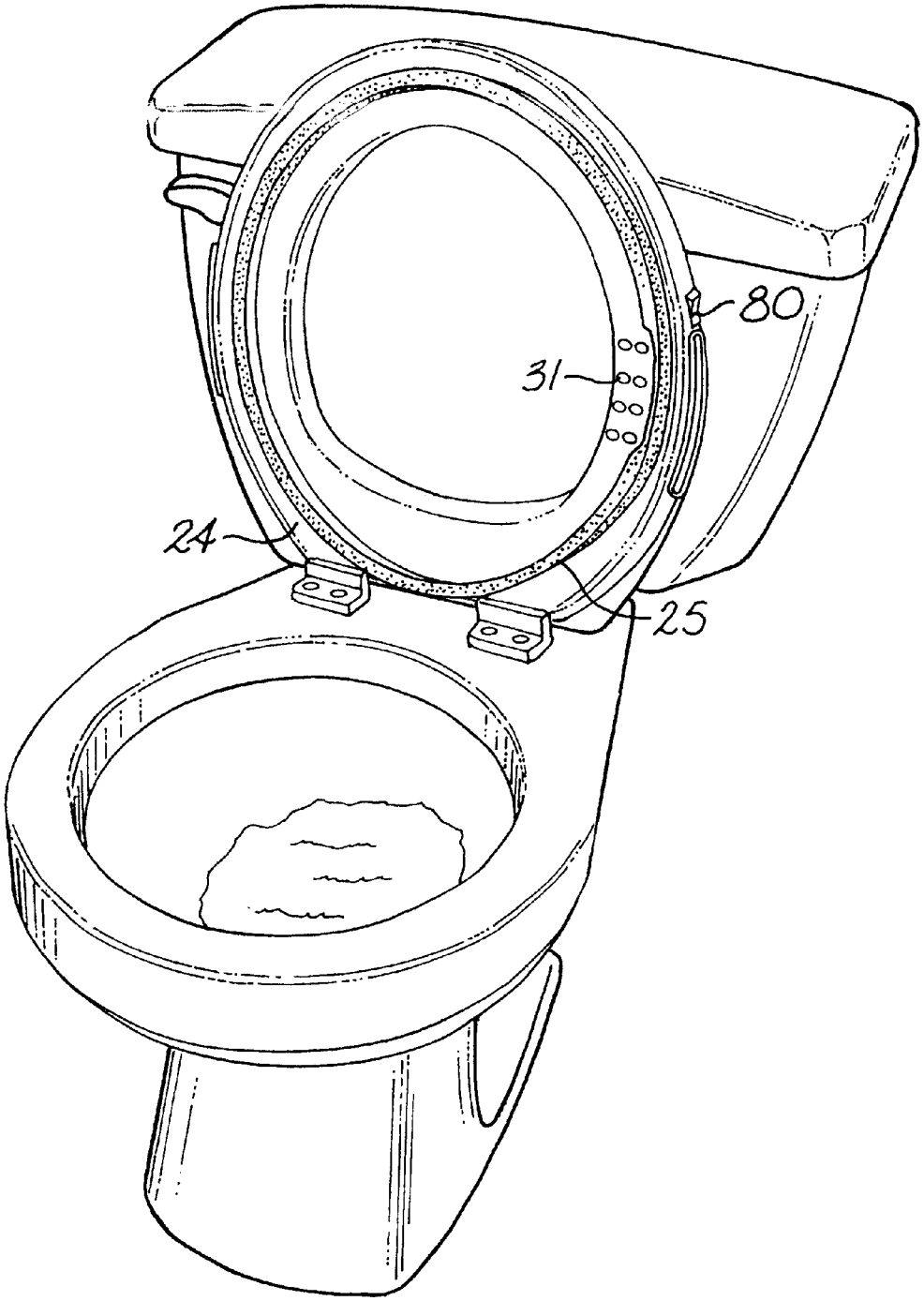
FIG. 6 is an alternative embodiment of a commode seat according to one aspect of this invention.
Figure 7:
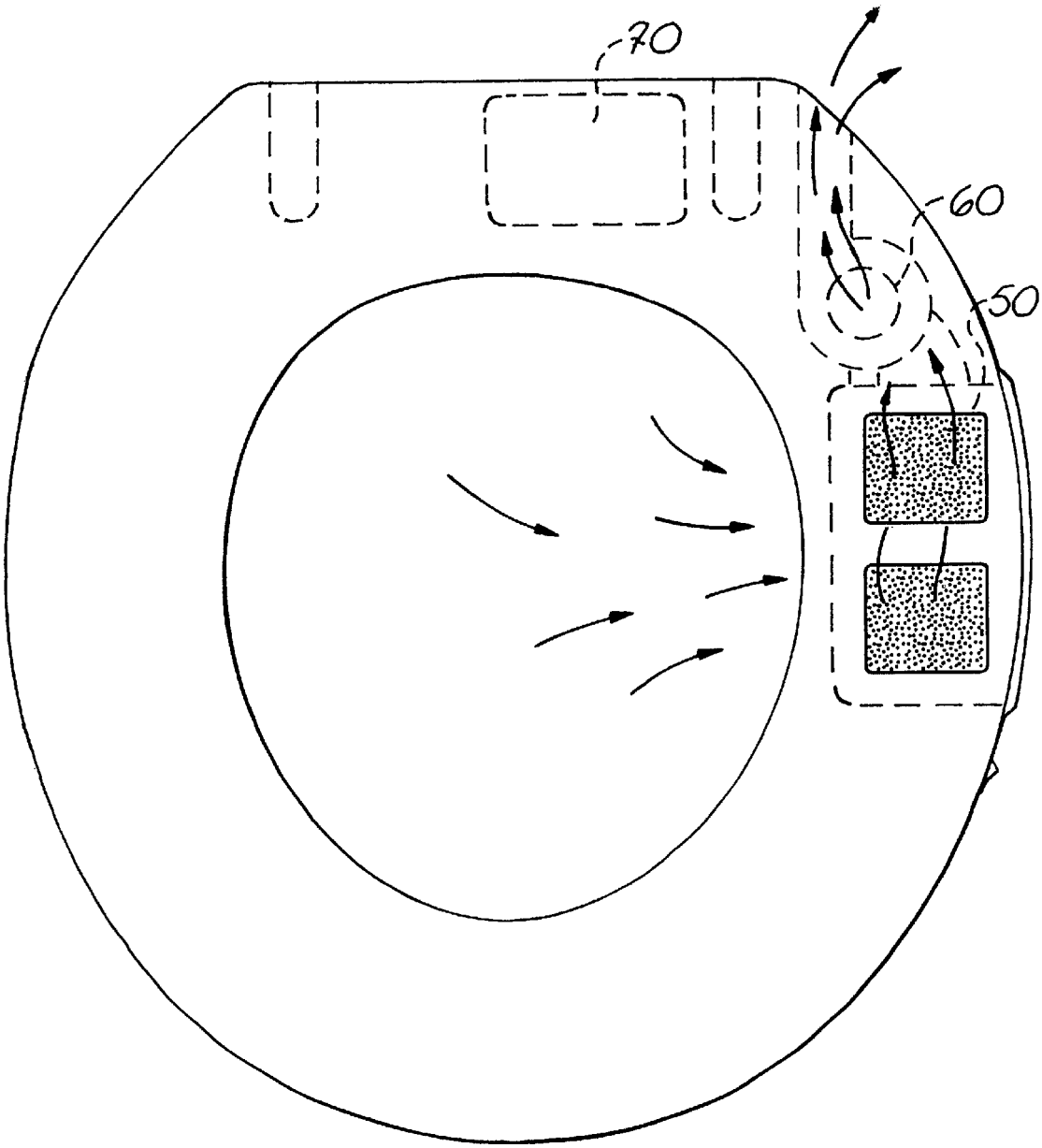
FIG. 7 is a top plan view of the commode seat seen in FIG. 6 and illustrating an airflow pathway of the commode seat.

An additional embodiment of a toilet seat is seen in reference to FIGS. 6–9. The illustrated additional embodiment provides a more compact air plenum defined within a side portion of the seat as best seen in FIG. 7. While the additional embodiment is illustrated in the form of a continuous, round toilet seat, it is understood and appreciated that the compact nature of the present invention will also fit within a conventional horseshoe shaped seat.

As best seen in reference to FIGS. 6 and 7, a bottom 24 of the seat 20 defines a plurality of apertures 31 or other air inlet(s). The apertures 31 are positioned along an inner portion of seat bottom 24 relative to the gasket 25 positioned on the lower seat surface. The seat 20 is adapted for receiving, in response to a fan or other forced air flow means, a supply of air through the apertures 31, the air being directed upwardly through the seat and through a carbon-activated filter seen in the form of filter 50 contained in cartridge 52. Upon exiting the filtration system, the filtered air flow, as indicated by the directional arrows, is conveyed along a plenum 40 that is partially formed within an interior length portion of the seat to an adjacent blower 60. The blower 60 has an inlet 62 in communication with the air passageway and serves to pull air in through the air apertures 31 and filter 50. The resulting filtered air flow exits the blower 60 along an outlet 64. A seat air outlet 32 is defined along a rear edge of the seat through which the air is discharged.

Figure 8:
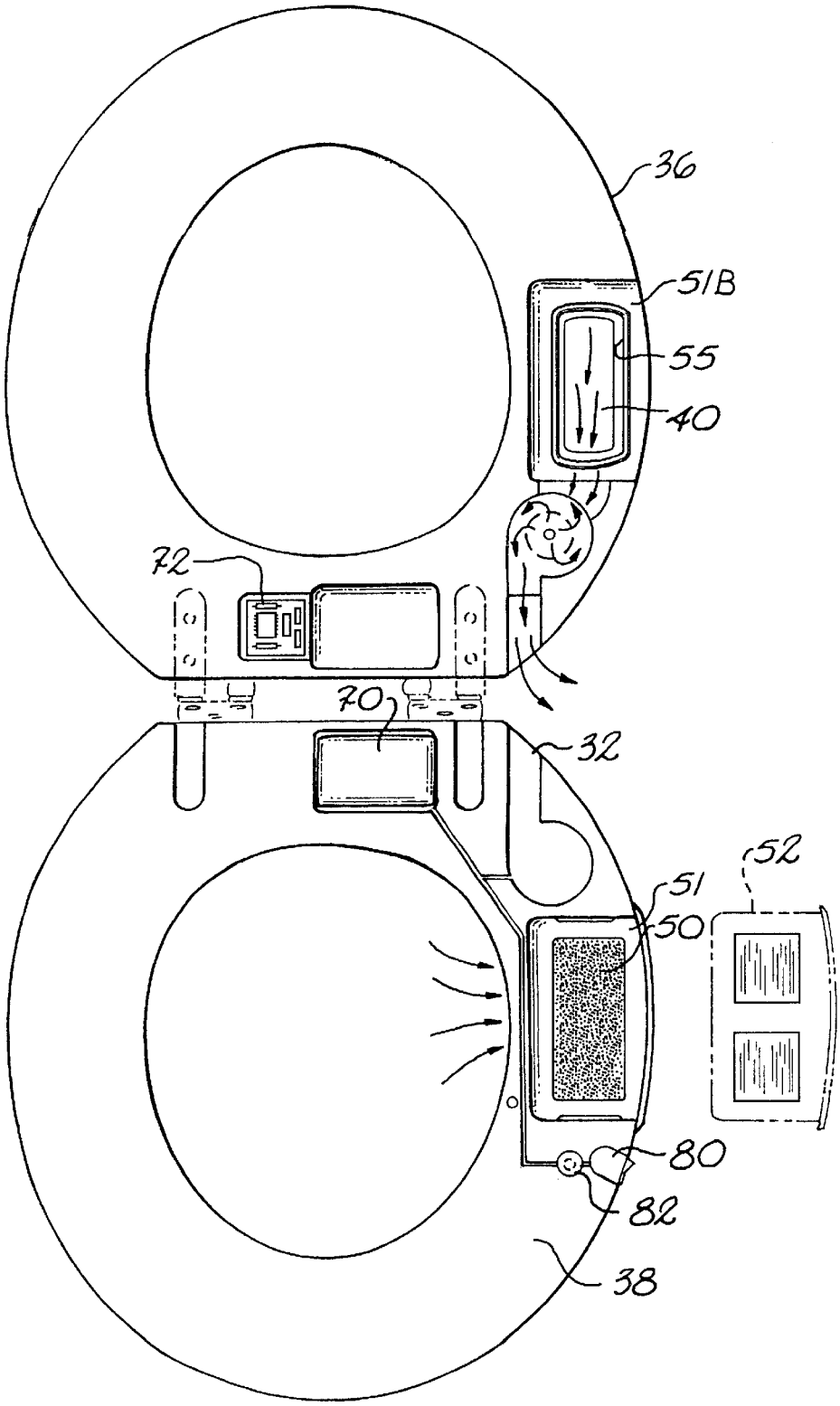
FIG. 8 is a plan view of the commode seat of FIG. 6 setting forth an upper and lower half of the commode seat along with additional details of the component parts.
Figure 9:
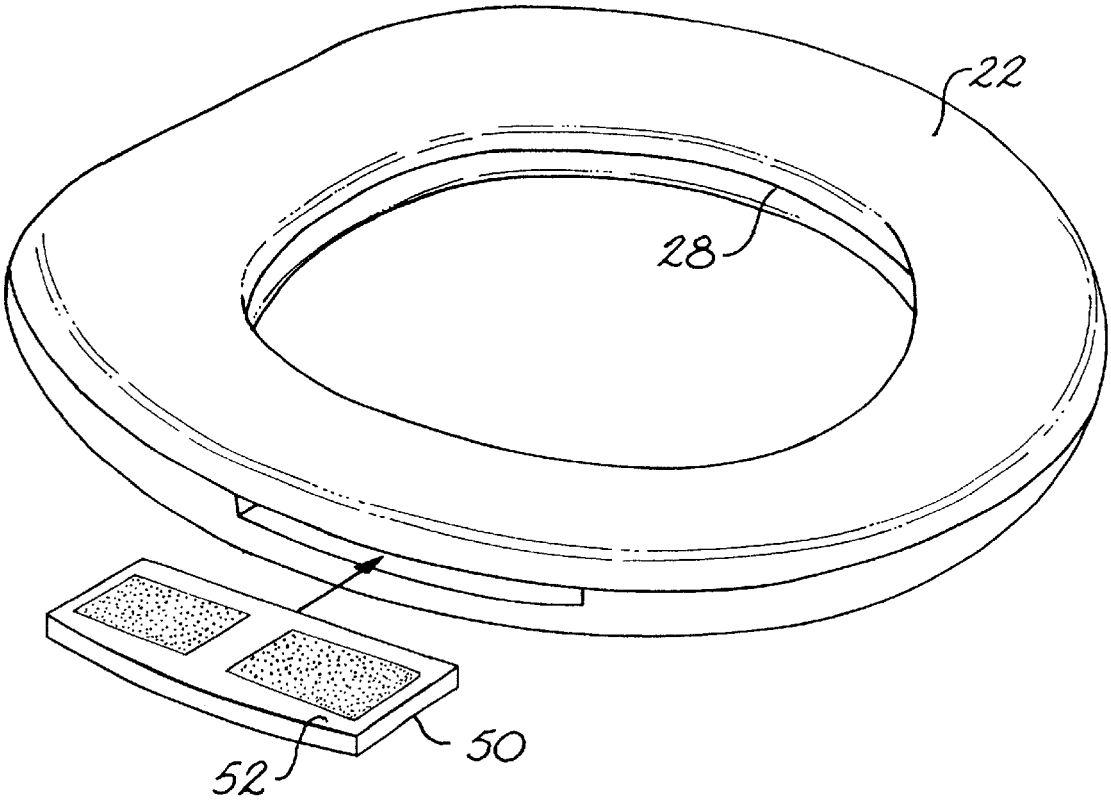
FIG. 9 is an isolated, side perspective view showing details of the removable filter cartridge as seen in the embodiment of FIG. 6.
Figure 10:
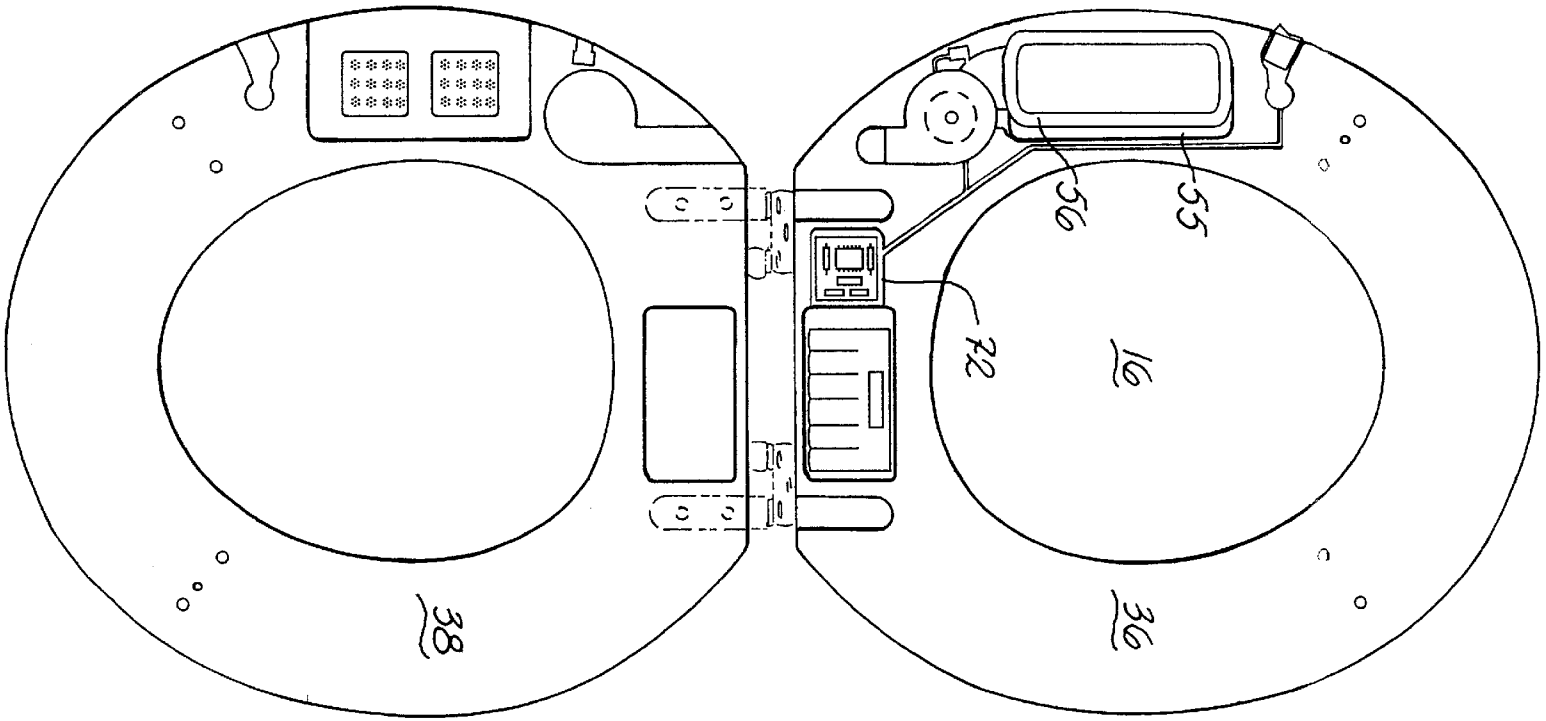
FIG. 10 is a plan view similar to FIG. 8 showing additional details of the construction and operation of an additional embodiment of the invention.

As best seen in reference to FIG. 8, and in reference to yet another embodiment of FIG. 10, the toilet seat may be in the form of a conventional wooden seat. The seat is split along the median cross section so as to divide the seat into a solid upper half 36 and a solid lower half 38, each upper and lower half having its own respective unitary character. As set forth in more detail below, the resulting cavities, air plenums, and component housings may then be milled or otherwise formed within the respective solid halves 36 and 38. Thereafter, the two halves may be joined using wooden dowels or other interlocking engagement means such as adhesives, engaging cams, fasteners, or friction fit engagement so as to provide an integral seat.

In reference to FIG. 8, the lower half 38 has defined therein an air passageway 40 that includes a first cavity 51. The cavity is adapted for receiving a slide-in cartridge module 52 seen here in the form of a two-stage parallel filter element. The filter media of a granulated activated carbon may be contained within a cartridge or other housing to facilitate the insertion and removal of the filter element.

The upper seat half 36 has a similarly positioned cavity 53 defined, which, when the toilet seat is operatively assembled, is positioned above the filter cavity 51 of the lower half 38. The upper cavity 53 further defines a ledge 55 for receiving a resilient gasket 56. The gasket 56 helps provide for an air tight seal about the filter and filter cartridge and thereby directs air flow into the adjacent position of air passageway 40 defined within the upper seat half and in communication with the upper cavity 51. As seen in reference to FIGS. 7 and 8, the air passageway 40 provides for air flow as seen by the directional arrows, the air passageway being in communication with an adjacent blower motor 60. The blower motor 60 is positioned within a housing formed between adjacent surfaces of the upper seat half and the lower seat half. Air exiting the blower is discharged along a portion of the air passageway 40 which may be defined by sections of both the upper and lower seat halves. As illustrated, the air exits through an outlet 32 defined by the seat such as lower seat half 38.

Additional details of construction of the additional embodiments are similar in respect to the features described in the first embodiment. In addition, it has been further found useful to include a timer circuit 72 that automatically turns off the blower motor following the passage of a pre-selected time interval. A time interval of between 3 to 4 minutes has been found useful. Given the quiet operation of the fan, the automatic cut-off switch is useful to prevent battery drain from individuals who may forget to manually disengage the unit.

An aspect in the operation of the present invention is the ability to provide for a strong flow of air through the granulated carbon filter. A suitable blower motor such as the Delta Motor BF B0512H (Delta Motor Company, Long Beach, Calif.) is rated by the manufacturer as having an air flow rate of 3.2 cubic feet per minute. This blower provides a sufficient flow of air through the seat including the attendant pressure drop across the filter. Since the air passageway occupies a compact volume, the volume of air that needs to be moved is kept at a minimum, thereby increasing the efficiency of the air filtration process.

It is also envisioned that the operative electronics, switches, filters, fan, and a defined air passageway including inlets and outlets may be provided within a single unitary cartridge or similar module. As such, the cartridge could be inserted into a conventional toilet seat that has an appropriate segment milled out or pre-molded for receipt of the unit.

It is preferred in one embodiment of the invention that the toilet seat utilize a solid wood toilet seat. This allows the seat to have sufficient strength and rigidity following the milling of the appropriate cavities, air plenums, and housings such that the strength and operation of the seat is not impaired. However, a plastic toilet seat, including hollow plastic seats, could be equipped with a slide-in cartridge. Alternatively, a plastic seat may be molded to include the appropriate cavities and housings that are described in the above embodiments.

A useful process for manufacturing a commode ventilation seat includes: providing a solid toilet seat; cutting a median cross section through the toilet seat, thereby providing a substantially solid first half and a second half; defining a cavity within at least one of the first half or the second half, the cavity adapted for receiving a filter housing; and, providing an air passage defined by the respective first half and second half, the air passage in communication with an inlet defined by the first seat half, said passage being in further communication with said cavity and with a fan housing defined by at least one of the first half or second half, the fan housing being in further communication with an air outlet defined by at least one of said first and said second halves.

An alternative manufacturing process can be provided by supplying a toilet seat; defining within the toilet seat a cavity; inserting within the cavity a cartridge, the cartridge defining an air passage in communication with an air inlet defined by a cartridge surface, the air inlet and air passage being in further communication with a filter element, the filter element being positioned within an air plenum or passage defined within the cartridge and operatively engaged by a blower motor, the blower motor positioned within the air plenum and adapted for directing a discharge of air through an air outlet defined by the cartridge; the cartridge further defining a power source such as a re-chargeable battery for operating the blower motor, the is blower motor responsive to a switch for selectively engaging the blower motor.

As discussed, this type of cartridge, having all of the necessary components and passageways pre-defined, can be inserted into a conventional toilet seat in which an appropriate cavity is milled, molded, or otherwise provided. Such a unitary cartridge insert can be used with virtually any type of toilet seat construction, including plastic seats which are molded so as to inter-engage the cartridge insert.

Although desired embodiments of the invention have been described using specific terms, materials, and methods, such description is for illustrative purposes only. The words used are words of description rather than of limitation. It is to be understood that changes and variations may be made by those of ordinary skill in the art without departing from the spirit and scope of the present invention which is set forth in the following claims. In addition, it should be understood that aspects of the various embodiments may be interchanged, both in whole or in part.

That which is claimed is:

1. A ventilation system for a commode comprising:

a solid commode seat having an upper seat half, a lower seat half, each seat half having an outer edge, and an inner edge, the inner edge defining a seat opening, said upper half having an upper surface to receive a user and a planer lower surface, said lower half having an upper planer surface and a lower surface;

an air inlet defined by said lower surface of the lower seat half, the air inlet in further communication with a first cavity formed in the upper surface of the lower seat half, said first cavity adapted for receiving a filter, an air passageway formed in said lower surface of said upper seat half and being in further communication with the first cavity and extending through said upper seat half to a fan housing defined within an interior of said commode seat, the fan housing receiving a fan; and, an air outlet, defined by an edge of a toilet seat and in communication with the fan housing.

2. The ventilation system according to claim 1 wherein the upper seat half and the lower seat half collectively define portions of the air passageway.

3. The ventilation system according to claim 1 wherein said solid commode seat further defines a power source in electrical communication with a fan, the fan positioned within the housing and responsive to a switch.

4. The ventilation system according to claim 3 wherein the fan is further responsive to a timer circuit which provides for a pre-determined interval of fan operation.

5. The ventilation system according to claim 1 wherein said air filter further comprises a filter having activated carbon for the removal of odors.

6. The ventilation system for a commode according to claim 1 wherein the upper seat half and the lower seat half are secured together by an adhesive.

7. The ventilation system according to claim 1 wherein the fan is a rotary blower.

8. A process for manufacturing a commode ventilation seat comprising:

providing a solid toilet seat;

cutting a median cross section through the toilet seat, thereby providing a an upper seat half, a lower seat half, each seat half having an outer edge, and an inner edge, the inner edge defining a seat opening, said upper half having an upper surface to receive a user and a planer lower surface, said lower half having an upper planer surface and a lower surface;

defining an air inlet defined by said lower surface of the lower seat half, the air inlet in further communication with a first cavity formed in the upper surface of the lower seat half, said first cavity adapted for receiving a filter; and, providing an air passage formed in said lower surface of said upper seat half and being in further communication with the first cavity and extending through said upper seat half to a fan housing defined within an Interior of said commode seat, the fan housing adapted for receiving a fan, the fan housing being in further communication with an air outlet defined by at least one of said upper seat half and said lower seat half.

9. A ventilation system for a commode comprising:

a solid commode seat having an upper seat half, a lower seat half, each seat half having an outer edge, and an inner edge, the inner edge surrounding in part a central opening defined by the solid commode seat, said upper half having an upper surface to receive a user and a planer lower surface, said lower half having an upper planer surface and a lower surface;

an air inlet defined by said lower surface of the lower seat half, the air inlet in further communication with an air plenum defined in part within an interior of the upper seat half and the lower seat half;

an air outlet defined along an outer edge of the commode seat and In communication with the air plenum;

a fan, positioned within a housing defined by the solid commode seat, the fan having an intake in communication with the air plenum and an exhaust port in further communication with the air plenum and adjacent the air outlet;

a filter, positionable within a filter housing defined by the interior of the solid commode seat, the filter housing further defining a portion of the air plenum; and a power source, the power source in electrical communication with the fan and further responsive to a switch, the switch accessible from an exterior of the solid commode seat.

10. The commode ventilation apparatus of claim 9 wherein the upper seat half and the lower seat half are secured by an adhesive.

11. The ventilation system according to claim 10 wherein the air filter is in communication with the portion of the air plenum defined by the lower seat half of the commode seat adjacent a filter intake, the filter further defining a filter outlet which is in communication with a portion of the air plenum defined by the upper seat half.

12. The ventilation system according to claim 10 wherein the upper seat half and the lower seat half are secured together by a plurality of dowels.

13. The ventilation system according to claim 9 wherein the fan is a rotary blower.

14. The ventilation system according to claim 9 wherein the fan is further responsive to a timer circuit which provides for a pre-determined interval of fan operation.

* * * * *